US010131478B2

(12) United States Patent
Maser

(10) Patent No.: US 10,131,478 B2
(45) Date of Patent: Nov. 20, 2018

(54) STORAGE DELIVERY BOX

(71) Applicant: Roman Maser, El Paso, TX (US)

(72) Inventor: Roman Maser, El Paso, TX (US)

( * ) Notice: Subject to any disclaimer, the term of this patent is extended or adjusted under 35 U.S.C. 154(b) by 0 days.

(21) Appl. No.: 15/661,119

(22) Filed: Jul. 27, 2017

(65) Prior Publication Data

US 2018/0029760 A1 Feb. 1, 2018

Related U.S. Application Data

(60) Provisional application No. 62/367,212, filed on Jul. 27, 2016.

(51) Int. Cl.

| | |
|---|---|
| ***E05B 45/06*** | (2006.01) |
| ***B65D 51/24*** | (2006.01) |
| ***B65D 25/14*** | (2006.01) |
| ***B65D 43/16*** | (2006.01) |
| ***B65D 55/14*** | (2006.01) |
| ***B65D 30/00*** | (2006.01) |
| ***G08B 13/06*** | (2006.01) |
| ***E05B 49/00*** | (2006.01) |
| ***E05B 65/52*** | (2006.01) |

(Continued)

(52) U.S. Cl.

CPC ..... *B65D 51/248* (2013.01); *B65D 25/14* (2013.01); *B65D 29/00* (2013.01); *B65D 43/16* (2013.01); *B65D 55/145* (2013.01); *E05B 45/06* (2013.01); *E05B 49/00* (2013.01); *E05B 65/52* (2013.01); *E05B 65/5223* (2013.01); *G07C 9/00817* (2013.01); *G07C 9/00896* (2013.01); *G08B 13/06* (2013.01); *G08B 13/1427* (2013.01); *B65D 2555/02* (2013.01); *E05B 2045/0695* (2013.01)

(58) Field of Classification Search

CPC ..... B65D 51/248; B65D 25/14; B65D 43/16; B65D 55/145; B65D 29/00; B65D 5/54; B65D 5/661; B65D 5/42; G08B 13/06; E05B 49/00; A47G 29/14; A47G 29/20; A47G 29/124; A47G 29/141; A47G 29/16; A47G 29/1214

USPC ..... 340/5.73, 545.6; 206/1.5, 521, 216; 232/36, 45, 19

See application file for complete search history.

(56) References Cited

U.S. PATENT DOCUMENTS 5,624,071 A 4/1997 Sosan
5,979,750 A * 11/1999 Kindell ..... A47G 29/141 232/1 R (Continued)

*Primary Examiner* — Hoi Lau

(74) *Attorney, Agent, or Firm* — Global Intellectual Property Agency, LLC; Daniel Boudwin

(57) ABSTRACT

A storage delivery box is provided. The storage delivery box includes a housing having a base, sidewalls, a lid, and an interior volume. The lid is hingedly attached to the housing for selectively providing access to the interior volume. The lid includes a locking mechanism configured to automatically secure the lid when in a closed position. A door lock disposed on the lid includes an input for unlocking the lid when in the closed position. An alarm system disposed on the housing is configured to detect intruders, activate a home alarm system and a recording device, and wirelessly communicate any attempted intrusions to an electronic device. An auxiliary net removably attachable to the interior volume is configured to receive items that are too large to fit within the interior volume and secure them exteriorly to the storage box.

11 Claims, 6 Drawing Sheets

(51) Int. Cl.
*G08B 13/14* (2006.01)
*G07C 9/00* (2006.01)

(56) References Cited

U.S. PATENT DOCUMENTS 6,155,715 A * 12/2000 Lake ..... A47G 29/20 150/102
6,928,415 B1 * 8/2005 Liberman ..... A47G 29/141 383/120
7,246,738 B2 * 7/2007 Jonas ..... A47G 29/16 232/29
7,256,691 B2 * 8/2007 Awobue ..... A47G 29/1214 232/17
8,358,199 B2 * 1/2013 Nesling ..... A47G 29/141 232/20
9,211,025 B1 * 12/2015 Elhawwashy ..... A47G 29/14
9,718,596 B1 * 8/2017 Russell ..... B65D 81/05
2004/0193096 A1 * 9/2004 Cooper ..... A61G 10/00 604/19
2005/0104730 A1 5/2005 Yang
2008/0017529 A1 * 1/2008 Herring ..... B65D 5/42 206/216
2012/0006714 A1 * 1/2012 Kasiwabara ..... B65D 81/051 206/521
2014/0008246 A1 * 1/2014 Pfeiffer ..... A45C 11/00 206/1.5
2015/0305538 A1 * 10/2015 Sundaresan ..... A47G 29/124 232/36
2016/0060008 A1 * 3/2016 Farentinos ..... B65D 43/16 220/211
2016/0304235 A1 * 10/2016 Herkenrath ..... B65D 5/54
2016/0309939 A1 * 10/2016 Mencel ..... A47G 29/20
2017/0127868 A1 * 5/2017 Adewuyi ..... A47G 29/124
2017/0143146 A1 * 5/2017 Charbeneau ..... A47G 29/141
2017/0320572 A1 * 11/2017 High ..... B64C 39/024
2018/0029760 A1 * 2/2018 Maser ..... B65D 51/248

* cited by examiner

STORAGE DELIVERY BOX

CROSS REFERENCE TO RELATED APPLICATION

This application claims the benefit of U.S. Provisional Application No. 62/367,212 filed on Jul. 27, 2016. The above identified patent application is herein incorporated by reference in its entirety to provide continuity of disclosure.

BACKGROUND OF THE INVENTION

The present invention relates to storage boxes for delivered packages. More specifically, the present invention relates to a storage box comprising an automatically securable lid, an alarm system configured to detect intruders, activate an alarm and recording device, and wirelessly communicate any attempted intrusions to an electronic device, and a retractable auxiliary net configured to store items that are too large to fit within the interior volume of the storage box and secure them exteriorly to the storage box.

The amount of merchandise being purchased online has significantly increased over the years. Internet purchases are very often delivered via a postal service. When packages are delivered, they are often left on a porch or in front of a doorway and are visible to others. If a customer is not home to immediately retrieve the package, the package is at risk of being stolen. Every year there are millions of reported stolen packages that owners were unable to retrieve. Many of these packages contain costly items, such as electronics, jewelry, or clothing. Currently, there is no effective means to ensure the security of a delivered item. Accordingly, a device located outside of a building that is configured to securely store a package until an owner is able to retrieve it is desired.

SUMMARY OF THE INVENTION

In view of the foregoing disadvantages inherent in the known types of storage boxes now present in the prior art, the present invention provides a new storage delivery box wherein the same can be used to securely store delivered packages until an owner can retrieve them and alert the owner of any attempted intrusions.

In one embodiment of the present invention, the storage delivery box comprises a housing including a base, one or more sidewalls, and an interior volume. The housing includes a lid comprising an automated locking mechanism, wherein the lid is hingedly attached to a sidewall of the housing, such that the lid is configured to move between an open and closed position. An alphanumerical keypad lock is disposed on the lid and is adapted to unlock the lid through the input of a user code. Apertures located on the housing are configured to secure the housing to a surface, such as a floor or a wall. The storage delivery box includes an alarm system comprising a control circuit and a memory. Sensors disposed on the lid and/or sidewalls of the housing are configured to detect mechanical vibrations and/or sharp rises in infrared radiation. The alarm system is activated when the sensors are triggered or when the incorrect user code is inputted into the alphanumerical keypad lock. Activation of the alarm system on the storage delivery box causes the control circuit to activate a user's home alarm system. Additionally, a camera disposed on the housing is configured to record audiovisual data when the sensors are triggered. The storage delivery box further comprises an auxiliary net with an interior volume larger than the interior volume of the housing, allowing for storage of items too large to fit into the housing. The base of the housing includes a latching mechanism configured to secure a perimeter edge of the auxiliary net to the interior volume of the housing.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
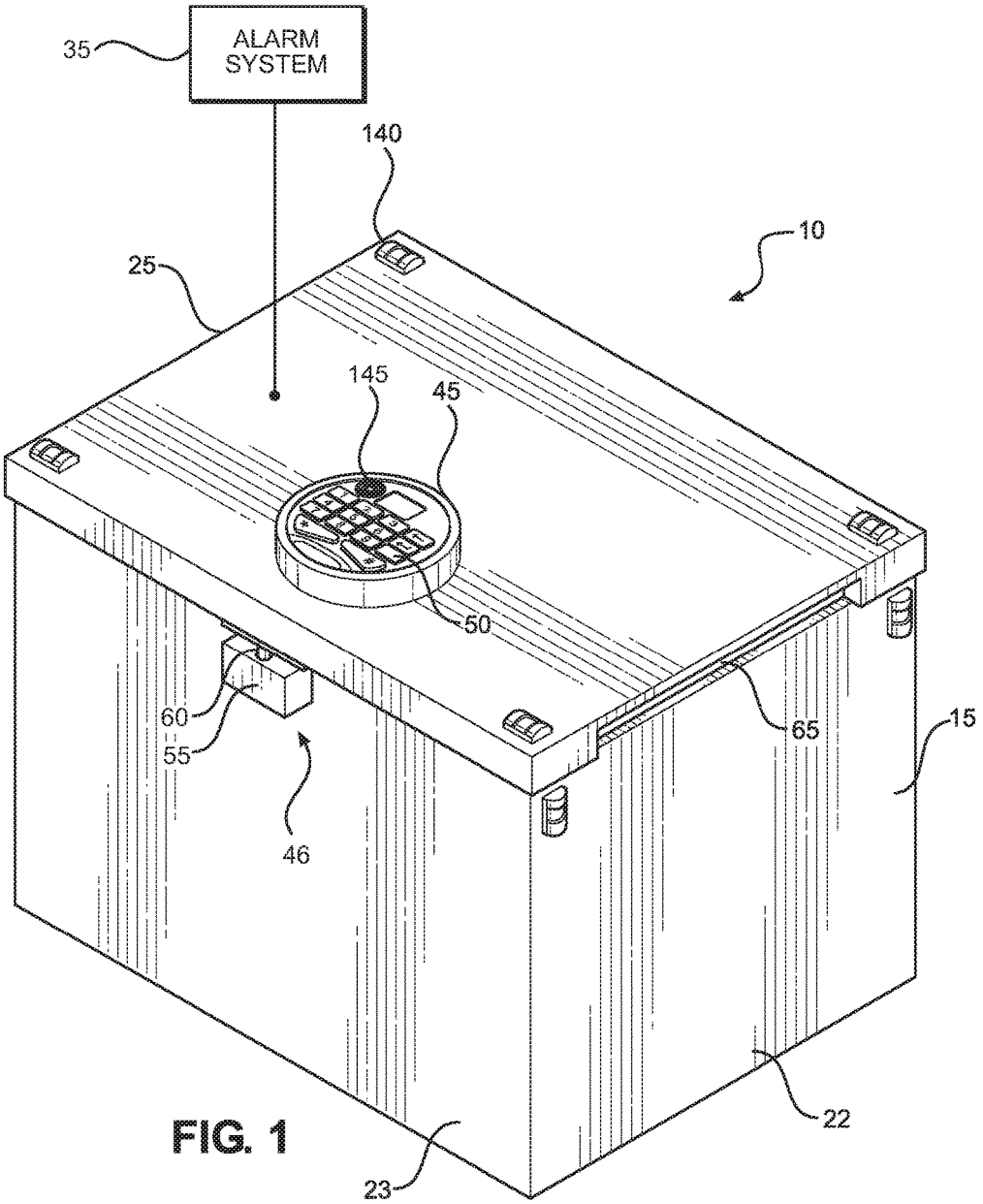
FIG. 1 shows a perspective view of the storage delivery box in a closed position according to one embodiment of the present invention.
Figure 2:
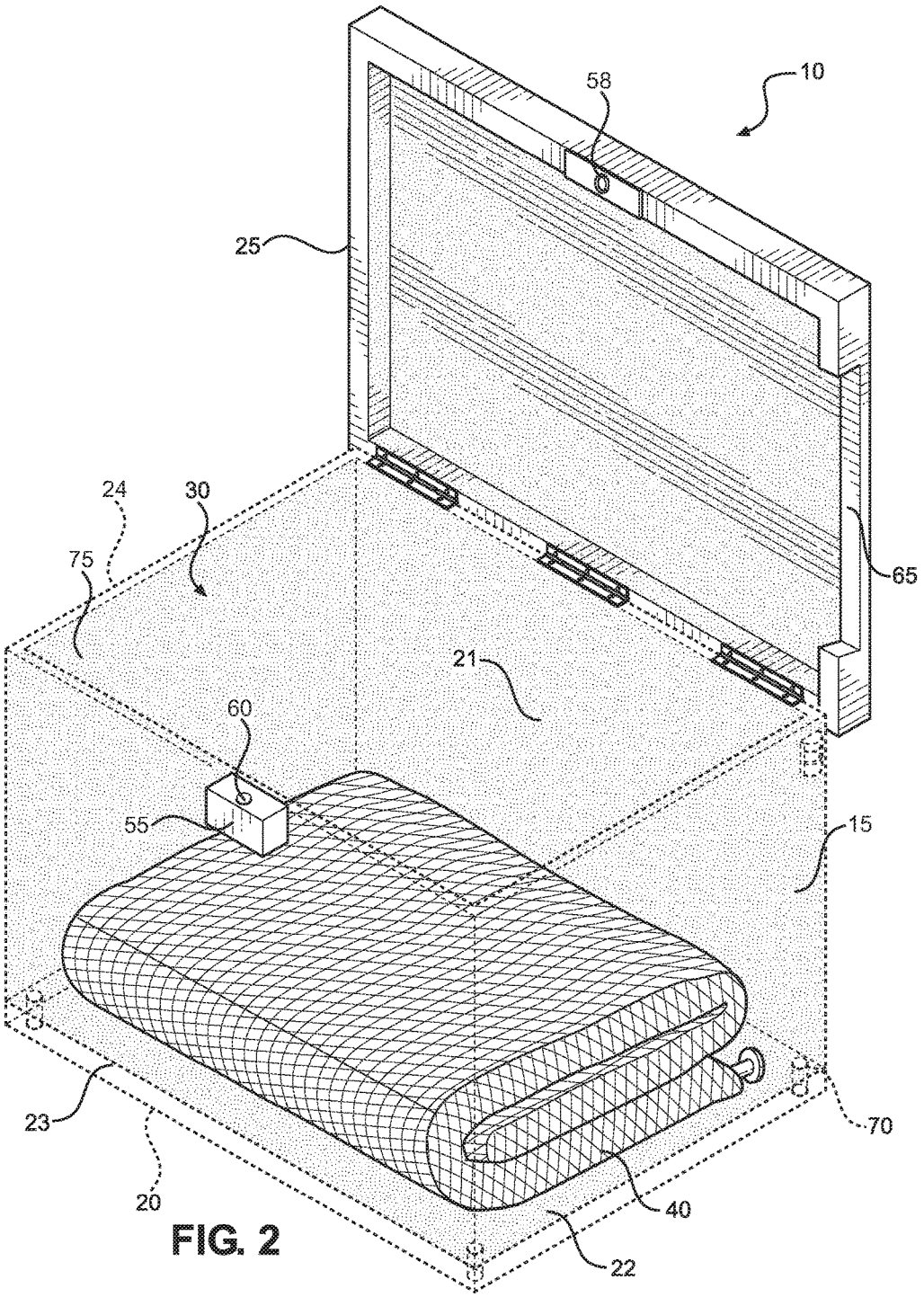
FIG. 2 shows a perspective phantom view of the storage box in an open position according to one embodiment of the present invention.

Referring now to FIGS. 1 and 2, there is shown a perspective view of the storage delivery box in a closed position and a perspective phantom view of the storage box in an open position, respectively. The storage delivery box 10 comprises a housing 15 including a base 20, one or more sidewalls 21-24, a lid 25, an interior volume 30 configured to store mail such as envelopes, packages and other items therein, an alarm system 35 including one or more sensors 140 and a camera 145 configured to detect intruders and notify users of attempted intrusions, and an auxiliary net 40 affixed to an interior of the storage delivery box 10 that is configured to receive items that are too large to fit within the interior volume 30 of the storage delivery box 10.

The lid 25 is hingedly connected to a sidewall 21 of the housing 15 and is configured to pivot between an open position and a closed position for selectively providing access to the interior volume 30. The lid 25 includes a door lock 45 including an input 50 for unlocking the lid when secured to the housing 15 and an automated locking mechanism 46 configured to automatically lock the lid 25 when in a closed position. The door lock 45 is programmable with a security access code that unlocks the lid 25 and allows entry into the storage delivery box 10. In the depicted embodiment, the input 50 of the door lock 45 includes an alphanumerical keypad lock requiring a user code for unlocking the lid 25 from the housing 15. The automated locking mechanism 46 includes an actuator 55 operably coupled to the door lock 45 and a fastener 60 that is configured to lock the lid 25 to the one or more sidewalls 21-24. The actuator 55 is triggered automatically when the lid 25 is in a closed position. In the depicted embodiment, the actuator 55 is disposed on front facing sidewall 23. When the lid 25 is moved to a closed position, the actuator 55 triggers and extends the fastener 60 into an aperture 58 disposed on the lid 25, thereby securing the lid 25 to the front facing sidewall 23. The fastener 60 remains in place until the lid 25 is unlocked by entering a correct security access code via the input 50. A correct security access code triggers the actuator 55 to retract the fastener 60 from the aperture 58 and enable access to the interior volume 30 of the housing 15. In the depicted embodiment, the fastener 60 includes a bolt retractably extendable from the actuator 55, and the actuator 55 includes an electric motor powered by a power supply such as a battery.

Figure 6:
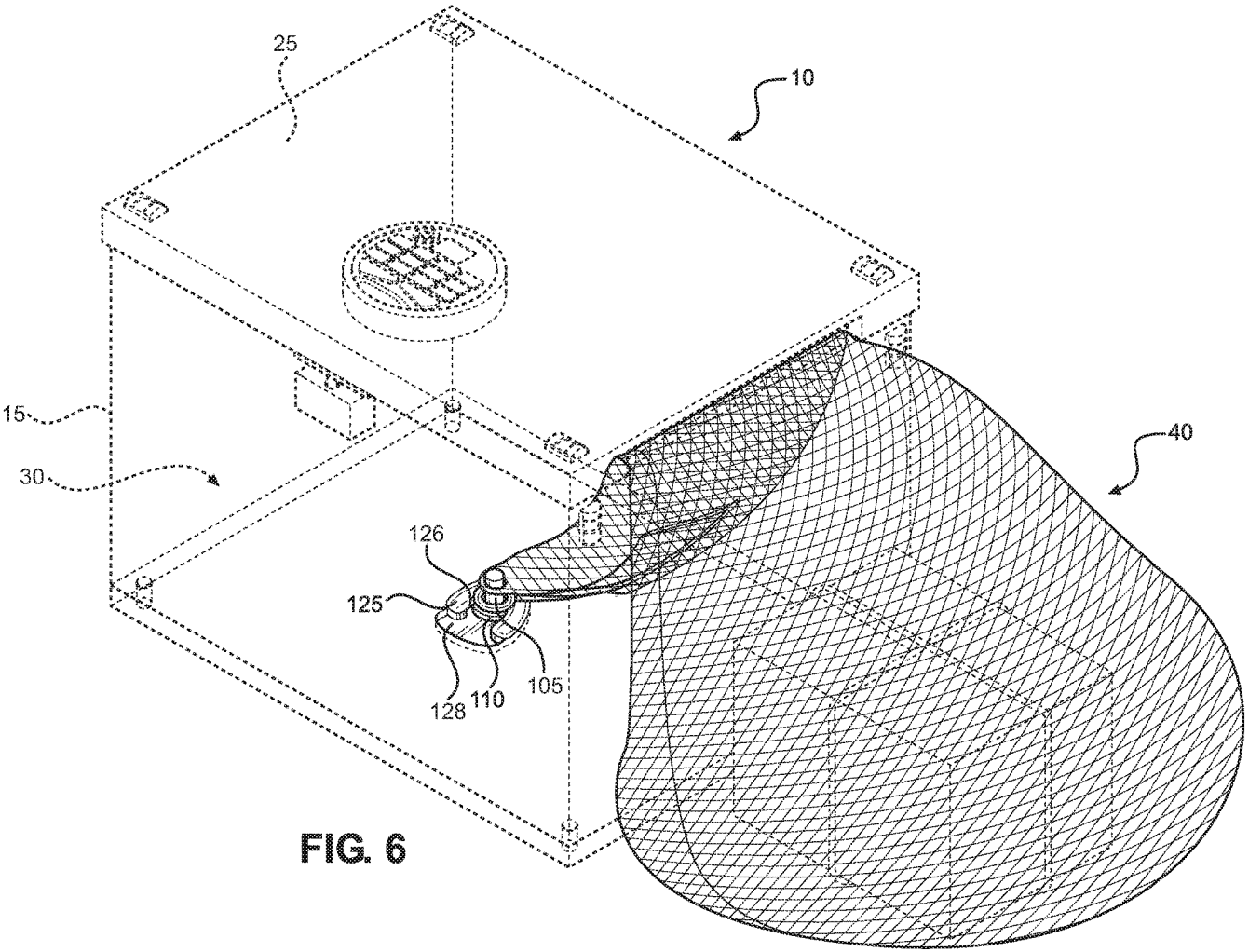
FIG. 6 shows a perspective phantom view of the auxiliary net of the storage delivery box in use.

The lid 25 includes a recessed portion 65 disposed on a side edge thereof that is configured to receive the auxiliary net 40 therethrough. In this way, the lid 25 can be secured to the housing 15 while the auxiliary net 40 is positioned exteriorly to the storage delivery box 10 and affixed to the interior volume 30 of the housing 15, as shown in FIG. 6. In operation, the lid 25 may be left open for a delivery. In some embodiments, a user code may be provided to a courier or delivery service to allow access to the storage delivery box 10 through the door lock 45. When the delivery is made, the courier closes the lid 25, which is then automatically locked in a closed position to the housing 15.

In one embodiment, the housing 15 includes one or more apertures 70 configured to removably receive fasteners therethrough for affixing the storage delivery box 10 to a surface, such as a floor or wall, such that the storage delivery box 10 may not be easily removed by intruders. The one or more apertures 70 are accessible via the interior volume 30 of the housing 15 and inaccessible from the exterior of the storage delivery box 10, so that an intruder may not access the fasteners. In one embodiment, the one or more apertures 70 are disposed on a sidewall 21-24 so that the storage delivery box 10 may be attached to a wall. In another embodiment, the one or more apertures 70 are disposed on the base 20, so that the storage delivery box 10 may be attached to a floor.

In one embodiment, the housing 15 includes a waterproof rubberized inner lining 75 disposed in the interior volume 30 that is configured to prevent water from entering the interior volume 30 of the housing 15. In alternate embodiments, however, the lining 75 consists of a material configured to protect the interior volume 30 of the housing 15 from external elements and damage.

Figure 3:
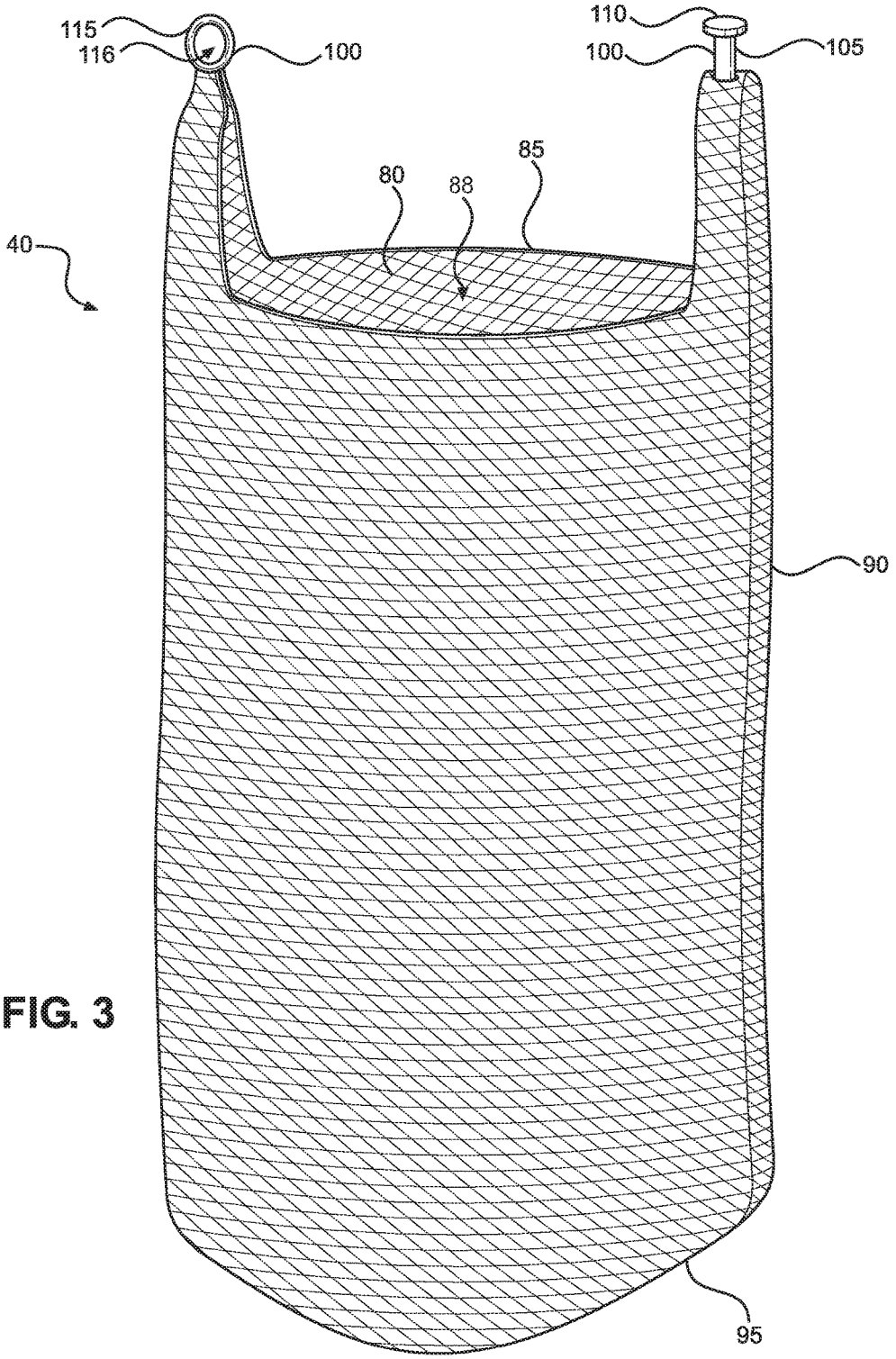
FIG. 3 shows a perspective view of the auxiliary net of the storage delivery box in an open position according to one embodiment of the present invention.

Referring now to FIG. 3, there is shown a perspective view of the auxiliary net of the storage delivery box in an open position according to one embodiment of the present invention. The auxiliary net 40 provides an alternative means for storing and securing a package if the package cannot fit within the storage delivery box. The auxiliary net 40 includes an interior volume 80 larger than an interior volume of the storage delivery box such that delivered items that are too large to fit within the interior volume of the storage delivery box may be placed in the auxiliary net 40. When items are placed in the auxiliary net 40, the auxiliary net 40 is closed and left outside of the storage delivery box while attached to the interior of the housing, as shown in FIG. 6.

The auxiliary net 40 includes an open upper end 85 defining an opening 88 that provides access to the interior volume 80, a middle portion 90, and a closed lower end 95. The auxiliary net 40 comprises a grid-like framework composed of a protective and resilient material that is configured to prevent an attempted intruder from cutting or ripping the auxiliary net 40 open. For instance, in the depicted embodiment, the auxiliary net 40 includes carbon nanotubes. In alternate embodiments, however, the auxiliary net 40 comprises alternative protective materials, such as other carbon fibered materials or metals, such as steel. The auxiliary net 40 includes a fastener 100 disposed on the open upper end 85 that is configured to close the opening 88. In the depicted embodiment, the fastener 100 is disposed on a perimeter edge of the opening 88 and comprises a locking pin 105 disposed on a side of the perimeter edge and a loop 115 disposed on an opposing side of the perimeter edge. The locking pin 105 includes a circular disc-like member 110 disposed at distal end thereof and the loop 115 includes an aperture 116 configured to receive the locking pin 105 therethrough. In operation, a user places the locking pin 105 through the loop 115, which is captured and retained on the locking pin 105 by the disc-like member 110, thereby securing the opposing sides of the opening 88 to each other and moving the auxiliary net 40 into a closed position.

Figure 4:
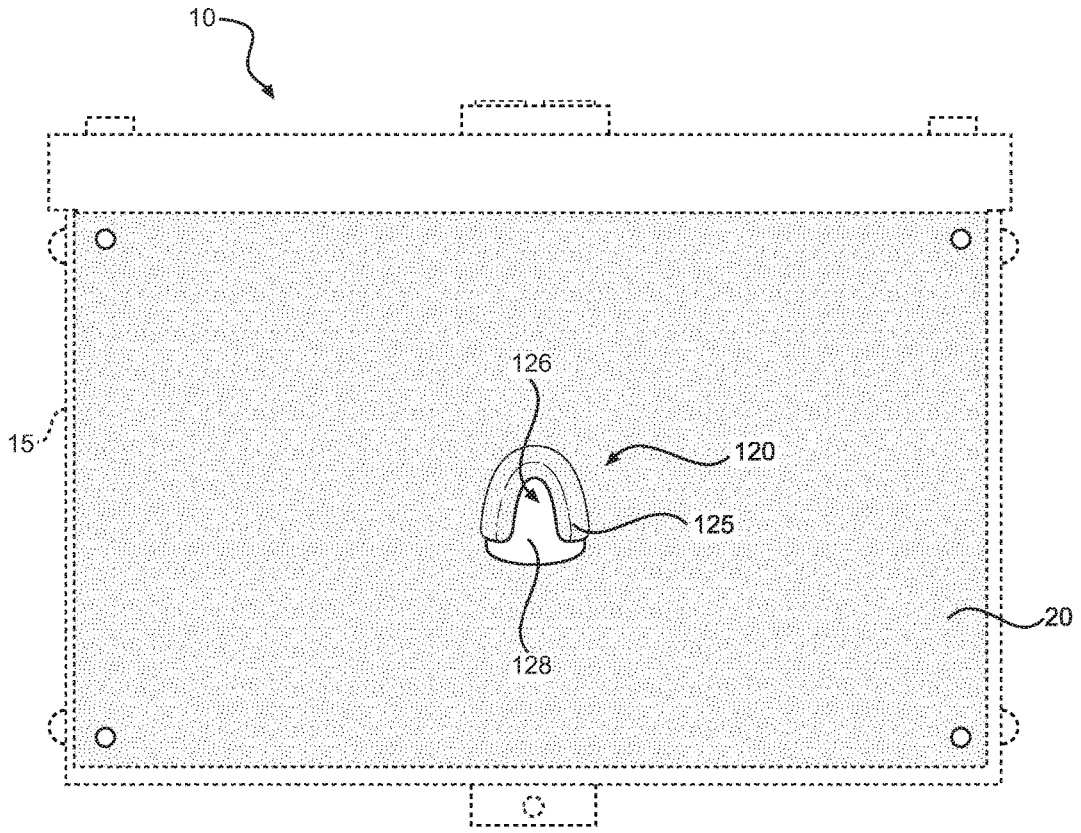
FIG. 4 shows a top plan view of the base of the storage delivery box according to one embodiment of the present invention.

Referring now to FIG. 4, there is shown a top plan view of the base of the storage delivery box according to one embodiment of the present invention. The storage delivery box 10 further includes a latching mechanism 120 configured to receive the locking pin of the auxiliary net for removably securing the auxiliary net thereto. In the depicted embodiment, the latching mechanism 120 is disposed on the base 20 of the housing 15 and includes an arcuate latch 125, a groove 128 disposed on the arcuate latch 126, and a recessed portion 128 that in conjunction are configured to removably receive the disc-like member and locking pin of the auxiliary net therein. When the locking pin is inserted into the latching mechanism 120, the recessed portion 126 receives the disc-like member and the groove 128 receives the locking pin. The groove 128 includes a diameter larger than a diameter of the disc-like portion such that arcuate latch 120 engages the disc-like member when inserted into the recessed portion 126. In this way, the arcuate latch 120 prevents the fastener of the auxiliary net from inadvertently unfastening from the latching mechanism 120 when inserted therein, thereby locking the auxiliary net to the interior of the housing 15, as shown by FIG. 6. In this way, the locking pin may only be accessed via the interior of the housing 15 and removed from the latch 125 when the storage delivery box 10 is opened.

Figure 5:
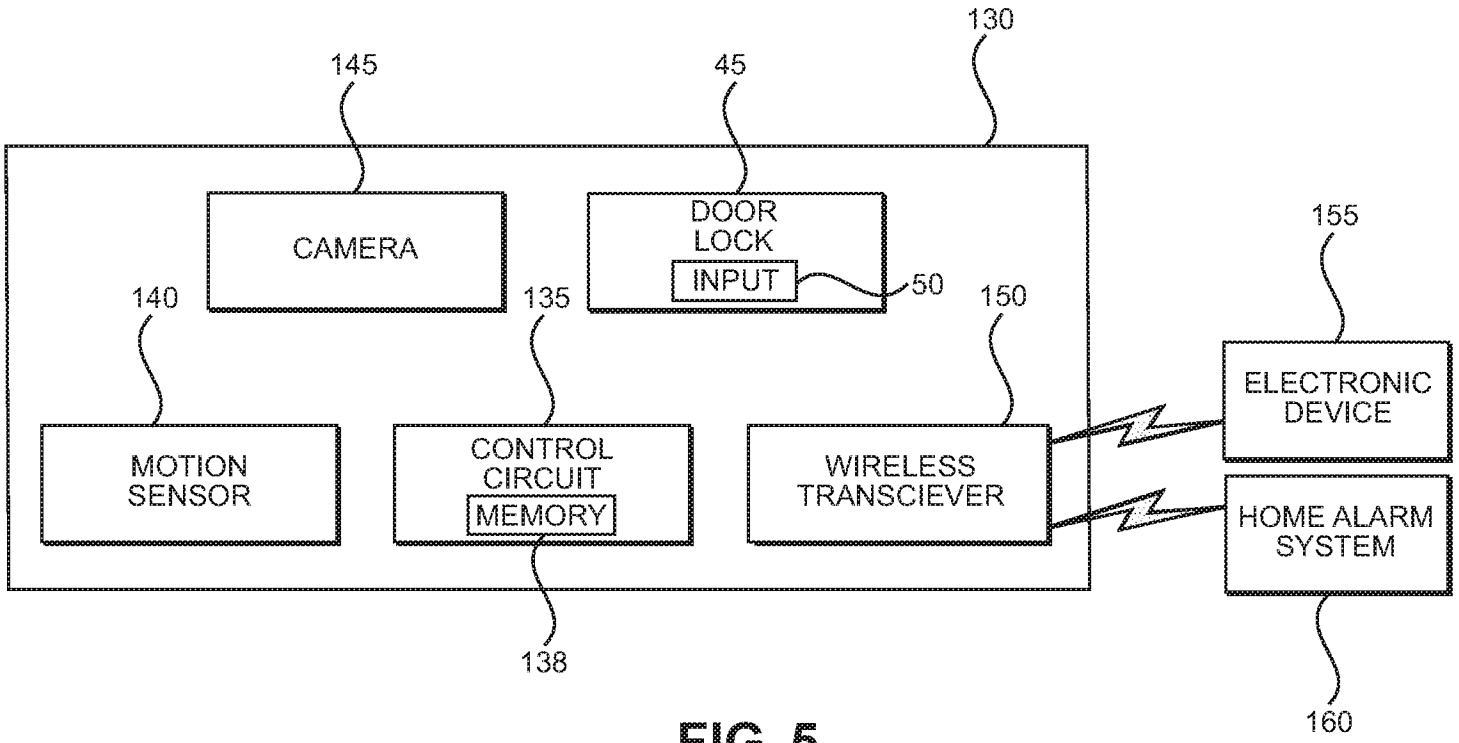
FIG. 5 shows a block diagram of the alarm system of the storage delivery box according to one embodiment of the present invention.

Referring now to FIG. 5, there is shown a block diagram of the alarm system of the storage delivery box according to one embodiment of the present invention. The alarm system 130 of the storage delivery box includes a control circuit 135 including a memory 138, the one or more sensors 140, the camera 145, and a wireless transceiver 150. In one embodiment, the alarm system 130 is disposed in the lid 25. In another embodiment, the alarm system 130 is disposed within the interior volume of the housing. The control circuit 135 is in communication with the one or more sensors 140, the camera 145, the wireless transceiver 150, and the door lock 45.

The one or more sensors 140 are disposed around the perimeter of the housing 15, as shown in FIG. 1. In one embodiment, the one or more sensors 140 include shock sensors, such as piezoelectric shock sensors or vibrations sensors, configured to detect the mechanical vibration of a sidewall of the storage deliver box. The shock sensors include vibration detectors that detect mechanical vibrations, such as those created by an intruder striking or tampering with the storage delivery box with a tool in an attempt to break into the storage delivery box, that are larger or heavier than certain threshold vibrations or threshold g-force value. In another embodiment, the one or more sensors include motion sensors, such as infrared motion sensors, that are configured to detect motion via infrared radiation. The infrared motion sensors include passive infrared motion detectors that detect sharp and rapid increases in infrared energy, such as body heat emanating from an intruder attempting to break into the storage delivery box or tampering with the auxiliary net or lid.

The camera 145 is disposed on the lid 25 and configured to capture audiovisual data of a delivery or an attempted intrusion, as shown in FIG. 1. Recorded audiovisual data is stored on the memory 138, such that the recorded data may be played back at a later time. The wireless transceiver 150 is configured to wirelessly transmit an alert to an electronic device 155, such as a mobile device or computer tablet, which informs a storage delivery box owner of a successful delivery or attempted intrusion. The wireless transceiver 150 further enables the alarm system 130 to communicate wirelessly with a home alarm system 160, such as the storage delivery box owner's home alarm system.

In operation, the alarm system 130 is triggered when a heavy mechanical vibration is detected by the one or more sensors 140, or when an incorrect code is entered into the input 50 on the door lock 45. When the alarm system 130 is triggered, the control circuit 135 activates the home alarm system 160 and transmits an alert to a user's electronic device 155 via the wireless transceiver 150 in order to notify the user of an attempted intrusion. If the alarm system 130 is triggered inadvertently, the alarm system 130 may be deactivated by entering a programmed security access code into the input 50 on the door lock 45. Moreover, when the alarm system 130 is triggered, the control circuit 135 activates the camera 145 in order to record the attempted intrusion. The camera 145 is further configured to begin recording during a delivery. The camera 145 is further configured to cease recording and deactivate after a specified amount of time of being activated.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications will occur to a person skilled in the art.

I claim:

1. A storage delivery box, comprising:

a housing including a base, one or more sidewalls, and an interior volume;

a lid hingedly connected to a sidewall of the housing for selectively moving the lid between an open position and a closed position;

an automated locking mechanism disposed on the lid;

an auxiliary net removably attachable to the interior volume of the housing, the auxiliary net including an open upper end, a middle portion, and a closed lower end;

a latching mechanism configured to secure the open upper end of the auxiliary net to the interior volume of the housing;

an aperture disposed on the housing, the aperture configured to receive a fastener therethrough for securing the housing to a surface; and an alarm system configured to activate upon an attempted intrusion, wherein upon activation the alarm system is configured to alert an owner of the attempted intrusion;

wherein the lid includes a recessed portion disposed on a side edge thereof, the recessed portion providing an area permitting closure of the lid over the middle portion of the auxiliary net when the open upper end of the auxiliary net is attached to the interior volume of the housing and the lower end of the auxiliary net is positioned outside of the housing.

2. The storage delivery box of claim 1, wherein the housing comprises a waterproof interior lining configured to protect the interior volume of the housing from precipitation.

3. The storage delivery box of claim 1, wherein the auxiliary net includes an interior volume larger than the interior volume of the housing.

4. The storage delivery box of claim 1, wherein the latching mechanism is disposed on the base of the housing and includes an arcuate latch, a recessed portion, and a groove configured to removably receive and secure the disc-like member of the auxiliary net therein.

5. The storage delivery box of claim 1, wherein the aperture is disposed on the base of the housing.

6. A storage delivery box, comprising:

a housing including a base, one or more sidewalls, and an interior volume;

a lid hingedly connected to a sidewall of the housing for selectively moving the lid between an open position and a closed position;

an automated locking mechanism disposed on the lid;

an auxiliary net removably attachable to the interior volume of the housing, the auxiliary net including an open upper end, a middle portion, and a closed lower end;

a latching mechanism configured to secure the open upper end of the auxiliary net to the interior volume of the housing;

an aperture disposed on the housing, the aperture configured to receive a fastener therethrough for securing the housing to a surface;

an alarm system configured to activate upon an attempted intrusion, wherein upon activation the alarm system is configured to alert an owner of the attempted intrusion;

wherein the open upper end of the auxiliary net defines a perimeter edge having a disc member and a loop disposed on opposing sides thereof, wherein the loop includes an aperture configured to receive the disc-like member.

7. A storage delivery box, comprising:

a housing including a base, one or more sidewalls, and an interior volume;

a lid hingedly connected to a sidewall of the housing for selectively moving the lid between an open position and a closed position;

an automated locking mechanism disposed on the lid;

an auxiliary net removably attachable to the interior volume of the housing, the auxiliary net including an open upper end, a middle portion, and a closed lower end;

a latching mechanism configured to secure the open upper end of the auxiliary net to the interior volume of the housing;

an aperture disposed on the housing, the aperture configured to receive a fastener therethrough for securing the housing to a surface;

an alarm system configured to activate upon an attempted intrusion, wherein upon activation the alarm system is configured to alert an owner of the attempted intrusion;

wherein the lid includes a door lock including an input for unlocking the lid when in a closed position;

wherein the input comprises a keypad lock including alphanumerical input keys, the input configured to unlock the lid when a correct programmed user code is inputted;

wherein the alarm system comprises:

a control circuit including a memory;

a wireless transceiver in communication with a home alarm system;

a sensor disposed on the housing, the sensor configured to detect an attempted intrusion into the housing when the lid is in a closed position;

wherein the alarm system is configured to activate when the sensor detects an attempted intrusion;

wherein the alarm system is configured to activate when an incorrect programmed user code is inputted;

wherein the alarm system is configured to cause the control circuit to activate the home alarm system via the wireless transceiver upon activation of the alarm system;

wherein the wireless transceiver is configured to transmit an alert to an electronic device upon activation of the alarm system.

8. The storage delivery box of claim 7, wherein the automated locking mechanism of the lid includes an actuator coupled to a fastener disposed on the lid, the actuator configured to automatically trigger the fastener to secure the lid to a sidewall when the lid is moved to a closed position, wherein the actuator is configured to unlock the fastener from the sidewall when the correct programmed user code is inputted and the lid is in the closed position.

9. The storage delivery box of claim 7, wherein the sensor comprises a shock sensor configured to detect the mechanical vibration of a sidewall of the housing, the shock sensor configured to activate the alarm system when the shock sensor detects a mechanical vibration larger than a threshold value.

10. The storage delivery box of claim 7, wherein the sensor comprises a motion sensor configured to detect sharp rises in infrared radiation, the motion sensor configured to activate the alarm system when the motion sensor detects a sharp rise in infrared radiation.

11. The storage delivery box of claim 7, wherein the alarm system further comprises a camera disposed on the housing, the camera including a memory, wherein the control circuit is configured to activate the camera upon activation of the alarm system, wherein the camera is configured to record audiovisual data on the memory when the camera is activated.

* * * * *